US007337755B2

(12) United States Patent
Gokan et al.

(10) Patent No.: US 7,337,755 B2
(45) Date of Patent: Mar. 4, 2008

(54) CYLINDER HEAD COOLING STRUCTURE FOR AN INTERNAL COMBUSTION ENGINE, INCLUDING AN OIL TEMPERATURE SENSOR AND AN OIL TEMPERATURE CONTROL SYSTEM

(75) Inventors: Yoshitsugu Gokan, Saitama (JP); Katsuji Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 14 days.

(21) Appl. No.: 11/235,374

(22) Filed: Sep. 26, 2005

(65) Prior Publication Data

US 2006/0065218 A1 Mar. 30, 2006

(30) Foreign Application Priority Data

Sep. 30, 2004 (JP) ..... 2004-286405
Sep. 30, 2004 (JP) ..... 2004-286406
Sep. 30, 2004 (JP) ..... 2004-286408

(51) Int. Cl.
*F02F 1/36* (2006.01)
*F02F 1/42* (2006.01)
*F01P 3/00* (2006.01)

(52) U.S. Cl. ..... 123/41.01; 123/41.82 R; 123/41.42; 123/193.3

(58) Field of Classification Search ..... 123/41.82 R, 123/41.42, 193.3, 196 M, 193.5
See application file for complete search history.

(56) References Cited

U.S. PATENT DOCUMENTS 4,972,807 A * 11/1990 Morishita ..... 123/41.82 R
5,081,960 A * 1/1992 Shimamoto ..... 123/41.82 R
5,094,193 A * 3/1992 Yoshikawa ..... 123/41.82 R
5,551,393 A * 9/1996 Amano et al. ..... 123/306
6,508,226 B2 * 1/2003 Tanaka et al. ..... 123/295
6,622,686 B2 * 9/2003 Komatsuda et al. ..... 123/193.5
7,124,731 B2 * 10/2006 Eguchi et al. ..... 123/196 M

FOREIGN PATENT DOCUMENTS

JP 2000-034915 2/2000
JP 2000-213326 8/2000

* cited by examiner

*Primary Examiner*—Stephen K. Cronin
*Assistant Examiner*—Hyder Ali
(74) *Attorney, Agent, or Firm*—Carrier, Blackman & Associates P.C.; Joseph P. Carrier; William D. Blackman

(57) ABSTRACT

A cylinder head cooling structure and an oil temperature control system are provided for an internal combustion engine having a plurality of cylinders, each having a plurality of intake ports and a plurality of exhaust ports. The engine includes cooling oil jackets surrounding the spark plugs in the cylinder head, a thermostat attached to the front surface of the crankcase independently of an oil filter, and an oil temperature sensor disposed on a rear face of the cylinder block above the crankcase in an oil supply path formed on the cylinder rear face for supplying oil to the oil jackets. Oil passages conducting oil into the oil jacket are provided between two separate parts of a bifucated intake port and between two separate parts of a bifurcated exhaust port, and only cooling system oil reaching high temperatures is allowed to flow through the thermostat, thereby improving temperature control response.

22 Claims, 9 Drawing Sheets

CYLINDER HEAD COOLING STRUCTURE FOR AN INTERNAL COMBUSTION ENGINE, INCLUDING AN OIL TEMPERATURE SENSOR AND AN OIL TEMPERATURE CONTROL SYSTEM

CROSS-REFERENCE TO RELATED APPLICATIONS

The present invention claims priority under 35 USC 119 based on Japanese patent applications No. 2004-286405, No. 2004-286406, and No. 2004-286408, each filed on Sep. 30, 2004. The subject matter of these priority documents is incorporated by reference herein.

BACKGROUND OF THE INVENTION

1. Field of the Invention

The present invention relates to cylinder head cooling structure for a four-cycle air-cooled internal combustion engine for a vehicle such as a motorcycle. The cylinder head cooling structure includes an oil temperature control system for cooling oil that, if necessary, circulates to cool a high temperature portion in an internal combustion engine by circulating the oil to an oil cooler according to the temperature of the oil. The cooling structure further includes an arrangement for an oil temperature sensor that makes it possible to precisely detect a cooling system oil temperature as a representative value of the temperature of an air-cooled internal combustion engine.

2. Description of the Background Art

In general, in a four-cycle air-cooled internal combustion engine, high-temperature portions are cooled by the heat radiation operation of cooling fins formed on the surface thereof. Since, however, the periphery of spark plug mounting holes and the periphery of combustion chamber-side openings of intake ports and exhaust ports are within the internal combustion engine, sufficient cooling cannot be performed by the heat radiation operation of cooling fins on the outer peripheral portions of the internal combustion engine. For this reason, an engine has been developed in which oil jackets are provided around the spark plug mounting holes, and a portion of lubricating oil is circulated via an oil passage for cooling. Such an engine is disclosed, for example, in FIG. 1 of Japanese Utility Model Laid-Open No. S61(1986)-32512.

In this example, the oil passage has been formed between the intake port and the exhaust port in a direction orthogonal to the ports so as to intersect a vehicle advancing direction at right angles. Therefore, the periphery of the spark plug mounting holes is cooled by the oil, but the periphery of the intake port and the exhaust port, which have high heat loads, is not sufficiently cooled.

It is an object of the present invention to provide structure in which not only the periphery of the spark plug mounting holes, but also the peripheries of the intake port and the exhaust port is sufficiently cooled by oil.

Conventionally, a thermostat (temperature sensing valve assembly) is integrated into the housing of an oil filter, and the housing is attached to the front of an internal combustion engine. This configuration is disclosed, for example, in FIGS. 1 and 2 Japanese Patent Laid-Open No. 2000-34915.

In the conventional configuration, since the thermostat is integrated with the oil filter and is attached to the front of the engine, it is difficult to maintain the oil filter, and the external appearance of the engine is degraded. In addition, cooling system oil and lubricating system oil have been allowed to flow together to a thermostat. In terms of oil used for cooling an internal combustion engine, therefore, the oil temperature control for a portion intended to be cooled tends to slow.

In a water-cooled internal combustion engine, the cooling water temperature is detected and used as a representative temperature of the internal combustion engine. However, in an air-cooled internal combustion engine, the temperature of oil circulating in the internal combustion engine is detected and used as a representative temperature of the internal combustion engine. In the prior art, an engine is disclosed in which a temperature sensor is arranged with an oil returning path, the oil returning path formed in a cylinder block in order to return oil supplied to a cylinder head to an oil pan. An oil temperature detected by the temperature sensor is used as a representative value of the internal combustion engine temperature. This configuration is disclosed, for example, in FIGS. 2 and 4 of Japanese Patent Laid-Open No. 2000-213326.

In this example, because the oil returning path is provided rather leftward at a lower portion of the cylinder block, the temperature sensor is arranged on the left side of the lower portion of the cylinder block. As a result, a body portion of the temperature sensor projects outwardly from the cylinder block. Further, the position at which the temperature sensor is attached in the example described above is a position which becomes the front face side of the internal combustion engine depending upon the angle of attachment of the internal combustion engine to a vehicle.

When a temperature sensor is arranged on an internal combustion engine for a small size vehicle, if the temperature sensor is arranged on a side face of a cylinder, then the width of the internal combustion engine increases. On the other hand, if the temperature sensor is arranged on a front face of the cylinder, and since the detection value of the sensor is varied by an influence of being exposed to water or the like, a protective member is required, and then the cost increases. Further, since an engine control unit (ECU), which uses the detected internal combustion temperature to control fuel injection and/or ignition, is usually placed rearward of the internal combustion engine, if the temperature sensor is provided downwardly or forwardly of the cylinder, then the wires from the temperature sensor to the ECU become undesirably long.

The present invention contemplates provision of an oil temperature sensor arrangement structure for an internal combustion engine in which exposure of the sensor to water is avoided and in which long wiring lines are not required.

SUMMARY

The present invention has solved the above-described problems. A first aspect of the invention relates to cylinder head cooling structure for a four-cycle air-cooled internal combustion engine having a plurality of cylinders. A plurality of intake ports and a plurality of exhaust ports are provided for each cylinder. The engine is formed with cooling oil jackets in the peripheries of the spark plugs in the cylinder head. The invention is characterized in that oil passages conducting oil in the oil jacket have been provided between two separate parts of a fork portion of the intake port and between two separate parts of a fork portion of the exhaust port.

According to the first aspect of the invention, it is possible to cool not only the periphery of the spark plug, but also the peripheries of the intake port, and the exhaust port, and the cylinder head are effectively cooled.

A second aspect of the invention, in addition to the cylinder head cooling structure for a four-cycle air-cooled internal combustion engine of the first aspect, is characterized in that a surface area of the oil passage provided between two separate parts of the fork portion of the exhaust port is larger than the surface area of the oil passage provided between two separate parts of the fork portion of the intake port.

According to the second aspect of the invention, by increasing a heat receiving area on the exhaust side having a high thermal load, cooling excellent in heat balance is realized.

A third aspect of the invention, in addition to the cylinder head cooling structure for a four-cycle air-cooled internal combustion engine of the second aspect, is characterized in that a width of the passage passing between two separate parts of the fork portion of the intake port is substantially constant, as viewed from above. In addition, a width of the passage passing between two separate parts of the fork portion of the exhaust port gradually enlarges from the spark plug toward the exhaust side, as viewed from above.

According to the third aspect of the invention, while bringing about the effect of the second aspect, it is possible to form the cylinder head by a casting process, and moreover, to form the oil jacket using a self-supporting core during casting. This facilitates casting. Also, since there is no need for machining for the formation of the oil jacket, or other members, the cost is reduced.

A fourth aspect of the invention, in addition to the cylinder head cooling structure for a four-cycle air-cooled internal combustion engine of the first through third aspects, is characterized in that the above-described air-cooled internal combustion engine is a multiple-cylinder internal combustion engine having a plurality of cylinders. The cylinder head-side oil passages, which communicate with an oil gallery and circulate the oil in the oil jacket, are independently formed for each of the respective cylinders.

According to the fourth aspect of the invention, the oil passages are independently formed for each respective cylinder, whereby it is possible to adequately control the flow rate of the oil to be supplied to each cylinder. As a result, the heat balance between the cylinders is improved.

A fifth aspect of the invention, in addition to the cylinder head cooling structure for a four-cycle air-cooled internal combustion engine of the first through fourth aspects, is characterized in that an oil supply system corresponding to the above-described oil jacket is a separate system from an oil supply system for lubrication of the internal combustion engine.

According to the fifth aspect of the invention, since it is possible to precisely set the flow rate of the oil required to cool the internal combustion engine and to properly supply the amount of the oil to be required for the cooling to a cooling system, the capacity of the oil pump is optimized. Also, since there is no need for causing the lubricating oil passage within the cylinder head to branch off from the cooling system oil passage, the oil passage is simplified and the working cost and the manufacturing cost are reduced. Moreover, the engine includes the cooling system oil circuit and the lubricating system oil circuit, which are independent of each other, and only the return oil of the cooling system is allowed to pass the thermostat. Therefore, proper temperature control is performed such that the cooling performance the cooling system requires is secured without being affected by the temperature of the lubricating system oil.

A sixth aspect of the invention relates to an oil temperature control system for an internal combustion engine, the engine mounted on a small vehicle and having a cylinder inclining slightly forward. An oil jacket is formed in a cylinder head joined to the cylinder, and is used to cool the cylinder head. An oil cooler is located forward of the engine, and a thermostat is used for controlling whether oil is introduced to or bypassed around the oil cooler. The oil that has passed the oil jacket is discharged to the front side of the cylinder head of the engine. The thermostat is attached to the front of the crankcase. After the oil that has been discharged to the front side of the engine passes the thermostat, the oil is delivered to the oil cooler located forward of the engine, or the oil is delivered to a bypass passage that detours around the oil cooler.

According to the sixth aspect of the invention, since only the oil that has passed the cooling system of the combustion chamber is introduced to the thermostat, oil temperature control in accordance with the thermal loading conditions of the combustion chamber is accurately achieved. Since the thermostat is directly attached to the front of the crankcase, the attachment rigidity of the thermostat is increased. In addition, since the surface area of the thermostat is added to the radiating surface area of the internal combustion engine itself, the cooling performance of the engine is enhanced.

The seventh aspect of the invention is characterized in that, in the oil temperature control system for an internal combustion engine according to claim sixth aspect, the thermostat is substantially located at the widthwise middle point of the engine.

The seventh aspect of the invention permits optimization of the piping layout. In addition, since the thermostat is substantially located at the middle point of the engine, and since the engine is symmetrical, the external appearance of the engine is improved.

An eighth aspect of the invention is characterized in that, in the oil temperature control system for an internal combustion engine of the seventh aspect, a return pipe extending from the oil cooler is connected to a portion directly below the thermostat.

According to the eighth aspect of the invention, the oil that has passed the bypass passage and the oil that has returned from the oil cooler is returned to a single oil passage. Therefore, the configuration of the crankcase is simplified and piping length is optimized.

A ninth aspect of the invention is characterized in that, in the oil temperature control system for an internal combustion engine of any one of the sixth to eighth aspects, the thermostat is located in a space surrounded by an exhaust pipe and the engine as viewed from a side of the vehicle. Additionally, the thermostat is located at a position interposed laterally between frames as viewed from the front of the vehicle.

According to the ninth aspect of the invention, the configuration in which the thermostat is located in a space surrounded by an exhaust pipe and the engine as viewed from a side of the vehicle, and interposed laterally between frames as viewed from the front of the vehicle permits protection of the thermostat without an additional protection member.

A tenth aspect of the invention relates to an oil temperature sensor arrangement structure for an internal combustion engine for a small size vehicle. The engine includes a crankcase, a cylinder block and a cylinder head and is arranged on the vehicle such that a cylinder axial line extends vertically or is inclined substantially forwardly. The invention is characterized in that the temperature sensor is provided on a rear face of the cylinder block above the crankcase.

According to the tenth aspect of the invention, since the oil temperature sensor (oil temperature sensor) is provided at a location at which it is unlikely to be influenced by a disturbance such as rainwater, high-accuracy temperature detection is achieved. Further, since the oil temperature sensor is protected against a flying stone or the like by the cylinder block and the crankcase, there is no necessity to provide a special protective member and costs are reduced. Furthermore, since an engine control unit is usually placed rearward of the internal combustion engine, a shorter harness is used by installing the oil temperature sensor rearward of the cylinder block. Consequently, the harness is reduced in weight and the arrangement of the harness is concentrated and simplified.

An eleventh aspect of the invention relates to an oil temperature sensor arrangement structure for an internal combustion engine of the tenth aspect, and is further characterized in that the oil temperature sensor arrangement structure comprises an oil jacket formed on the cylinder head and an oil supply path formed on a rear face of a cylinder for supplying oil to the oil jacket, and the oil temperature sensor is arranged within the oil supply path.

According to the eleventh aspect of the invention, since the oil temperature sensor is provided in the oil supply path for the oil jacket, which requires a large amount of oil, the influence on the oil temperature of a location where the thermal load is locally high is reduced. In addition, it is possible to detect the oil temperature as a stabilized representative value of an operation state of the internal combustion engine. Generally, when compared with a case wherein the oil temperature sensor is arranged on the oil returning side, the oil temperature detected on the supply side is lower. Particularly in an internal combustion engine to which a high thermal load is applied, or an internal combustion engine wherein an oil jacket is formed such that the internal combustion engine is cooled positively from among high-output power internal combustion engines, the oil temperature on the returning side is high. The accuracy of the temperature sensor deteriorates in a state wherein the detection temperature is high. By providing the oil temperature sensor for the oil supply path in which the temperature is low in place of an expensive temperature sensor which maintains a high degree of accuracy in a high temperature state, a stabilized representative value of an operation state is detected with a high degree accuracy by a less expensive sensor.

A twelfth aspect of the invention relates to the oil temperature sensor arrangement structure for an internal combustion engine of the eleventh aspect, and is characterized in that the internal combustion engine includes a plurality of cylinders, and an independent oil jacket is provided for each of the cylinders. A supply side oil gallery is provided which connects to one oil supply path on the upstream side, and oil paths connecting to the individual oil jackets are individually branched from the supply side oil gallery. The oil temperature sensor is provided in the proximity of an entrance portion of the supply side oil gallery.

According to the twelfth aspect of the invention, since the oil temperature sensor is provided in the proximity of the entrance portion of the supply side oil gallery, the temperature is detected in a state wherein the oil flow rate is high. Accordingly, stabilized temperature detection is achieved.

A thirteenth aspect of the invention relates to the oil temperature sensor arrangement structure for an internal combustion engine of the twelfth aspect, and is characterized in that the supply side oil gallery is provided at a lower end portion of the rear face of the cylinder.

According to the thirteenth aspect of invention, since the supply side oil gallery is provided in a dead space at a lower end portion of the rear face of the cylinder, the internal combustion engine is compactly formed.

A fourteenth aspect of the invention relates to the oil temperature sensor arrangement structure for an internal combustion engine of the thirteenth aspect, and is characterized in that the oil temperature sensor is provided in an inclined relationship in a direction in which a harness side thereof is spaced away from the crankcase with respect to the cylinder axial line.

According to the fourteenth aspect of the invention, the harness length is reduced and assembly of the harness is facilitated.

A fifteenth aspect of the invention relates to the oil temperature sensor arrangement structure for an internal combustion engine according to any one of the eleventh through fourteenth aspects, and is characterized in that the internal combustion engine is an OHC type internal combustion engine having a camshaft on the cylinder head. The driving force of the crankshaft is transmitted to the camshaft by a chain, and a chain tensioner for making the tension of the chain fixed is provided on the rear face of the cylinder. The oil temperature sensor is arranged below the chain tensioner.

According to the fifteenth aspect of the invention, a dead space below the chain tensioner is utilized effectively. Further, since the chain tensioner is a more rigid body than the temperature sensor, and since the temperature sensor is provided below the chain tensioner, the temperature sensor is prevented from being contacted by an article by the chain tensioner.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art.

Figure 1:
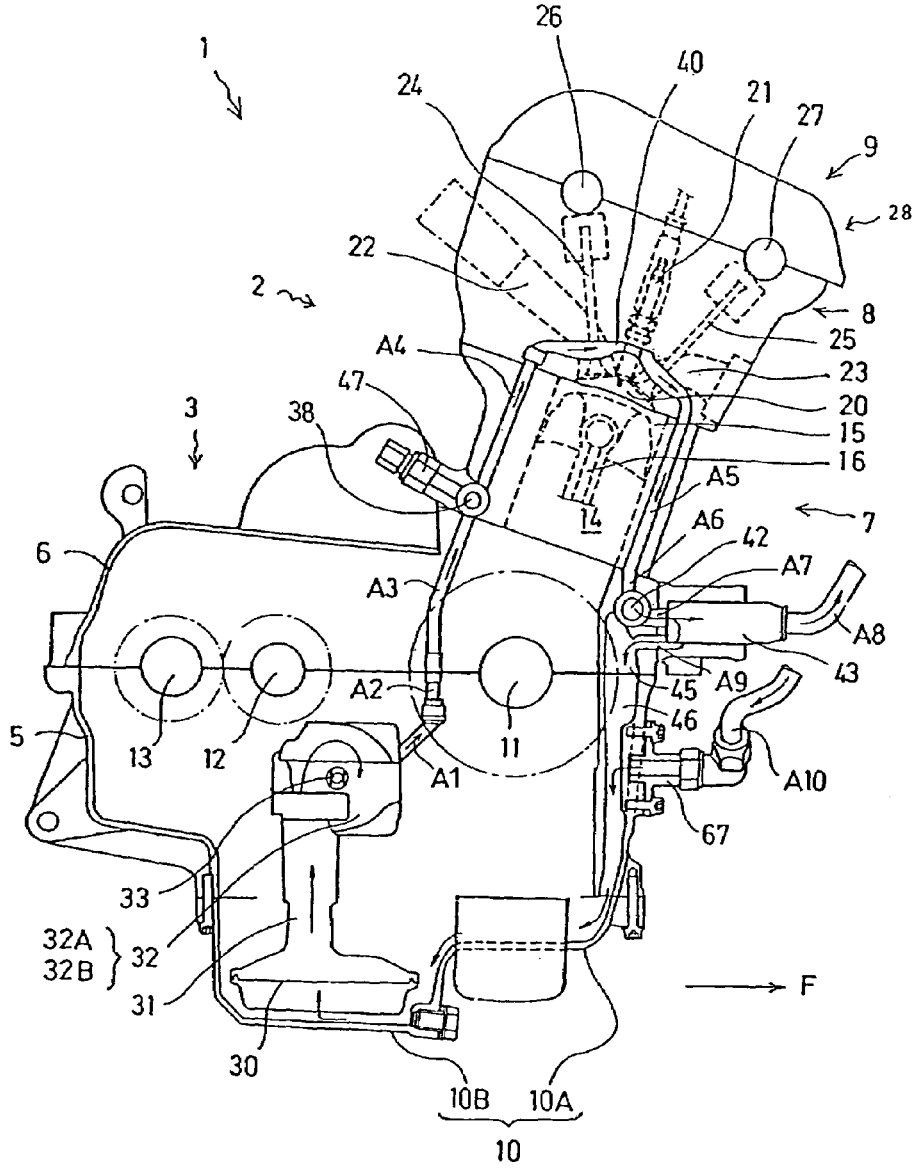
FIG. 1 is a side sectional view of an internal combustion engine of the present embodiment showing a cooling system oil circuit.

FIG. 1 is a view showing a cooling system oil circuit on a view of a vertical section of a four-cylinder DOHC wet sump type internal combustion engine 1 according to an embodiment of the present invention as viewed from the right side. An arrow mark F indicates the forward direction of the internal combustion engine 1. The internal combustion engine 1 includes a power generation section 2 and a transmission section 3 integrated with each other. An outer shell of the internal combustion engine 1 is formed from a lower crankcase 5, an upper crankcase 6, a cylinder block 7, a cylinder head 8, a cylinder head cover 9, and an oil pan 10. A crankshaft 11, a main shaft 12 of a speed change gear and a counter shaft 13 are supported for rotation on bearings on mating surfaces of the crankcases 5 and 6, which are divided horizontally into two case portions.

The cylinder block 7 is of a four-cylinder type, and a piston 15 is accommodated for sliding movement in each of the four cylinder holes 14. Each piston 15 is connected to the crankshaft 11 through a connecting rod 16. A combustion chamber 20 is provided at a lower portion of the cylinder head 8, which is opposed to an upper face of each of the pistons 15.

A spark plug 21 is inserted in a central portion of an upper portion of each of the combustion chambers 20 from above the cylinder head 8 such that an end thereof is exposed to the combustion chamber 20. The cylinder head 8 has intake ports 22 and exhaust ports 23 provided therein, the intake and exhaust ports 22, 23 individually connected to the combustion chambers 20 such that inner ends of them are open to the combustion chambers. Intake valves 24 and exhaust valves 25 are provided at inner end openings of the intake ports 22 and the exhaust ports 23 for opening and closing the openings, respectively. A valve system 28 including an intake camshaft 26 and an exhaust camshaft 27 is provided in the proximity of mating surfaces of the cylinder head 8 and the cylinder head cover 9.

The oil pan 10 includes a shallow bottom portion 10A and a deep bottom portion 10B, and is connected to a lower portion of the lower crankcase 5. An oil intake pipe 31, including a strainer 30, is provided at the deep bottom portion 10B of the oil pan 10, and an oil pump 32 is connected to an upper portion of the oil intake pipe 31. The oil pump 32 includes a cooling system oil pump 32A and a lubricating system oil pump 32B, and both pumps 32A, 32B are connected to the same oil pump shaft 33.

A cooling system oil circuit and a lubricating system oil circuit are provided independently of each other in the internal combustion engine. Oil is supplied to the oil circuits separately from each other from the cooling system oil pump 32A and the lubricating system oil pump 32B. The cooling system oil circuit is shown in FIG. 1 while the lubricating system oil circuit is shown in FIG. 2.

In the cooling system oil circuit of FIG. 1, a cooling system discharge pipe A1 connecting to the cooling system oil pump 32A extends upwardly. This pipe extends to a cooling system supply side oil gallery 38 provided in the cylinder block 7 via a lower crankcase oil path A2 and an upper crankcase oil path A3. An oil temperature sensor 47 is provided so as to intersect the oil gallery 38. An oil path from the oil gallery 38 is branched to cooling system supply oil paths A4 provided for each of the individual cylinders in a rear wall of the cylinder block 7. The oil paths A4 connect to oil jackets 40 and are provided independently of each other for the individual cylinders in the cylinder head 8. The oil jackets 40 connect to cooling system returning oil paths A5 provided in a front wall of the cylinder block 7, and extend to cooling system returning side oil galleries 42 through returning oil paths A6 provided in the upper crankcase 6.

Beyond the cooling system returning side oil galleries 42, the oil paths join together to one oil path, which extends to a thermostat 43 through a communicating oil path A7 provided in the upper crankcase 6. In the present apparatus, when the oil temperature is high, an oil port connecting to an oil cooler is opened by the thermostat 43, and the oil flows to an oil cooler communicating pipe A8. When the oil temperature is low, the oil port connecting to the oil cooler is closed by the thermostat 43, and the oil flows through a bypass path A9 into an upper crankcase oil returning path 45 in the upper crankcase. Returning oil from a returning connecting pipe A10, connected to the oil cooler, flows into a lower crankcase oil returning path 46 connecting to the upper crankcase oil returning path 45 through an oil cooler returning pipe attachment portion 67. The oil flowing into the crankcase oil returning paths 45 and 46 flows downwardly and returns into the oil pan 10. An outline of the cooling system oil circuit is such as described above.

Figure 2:
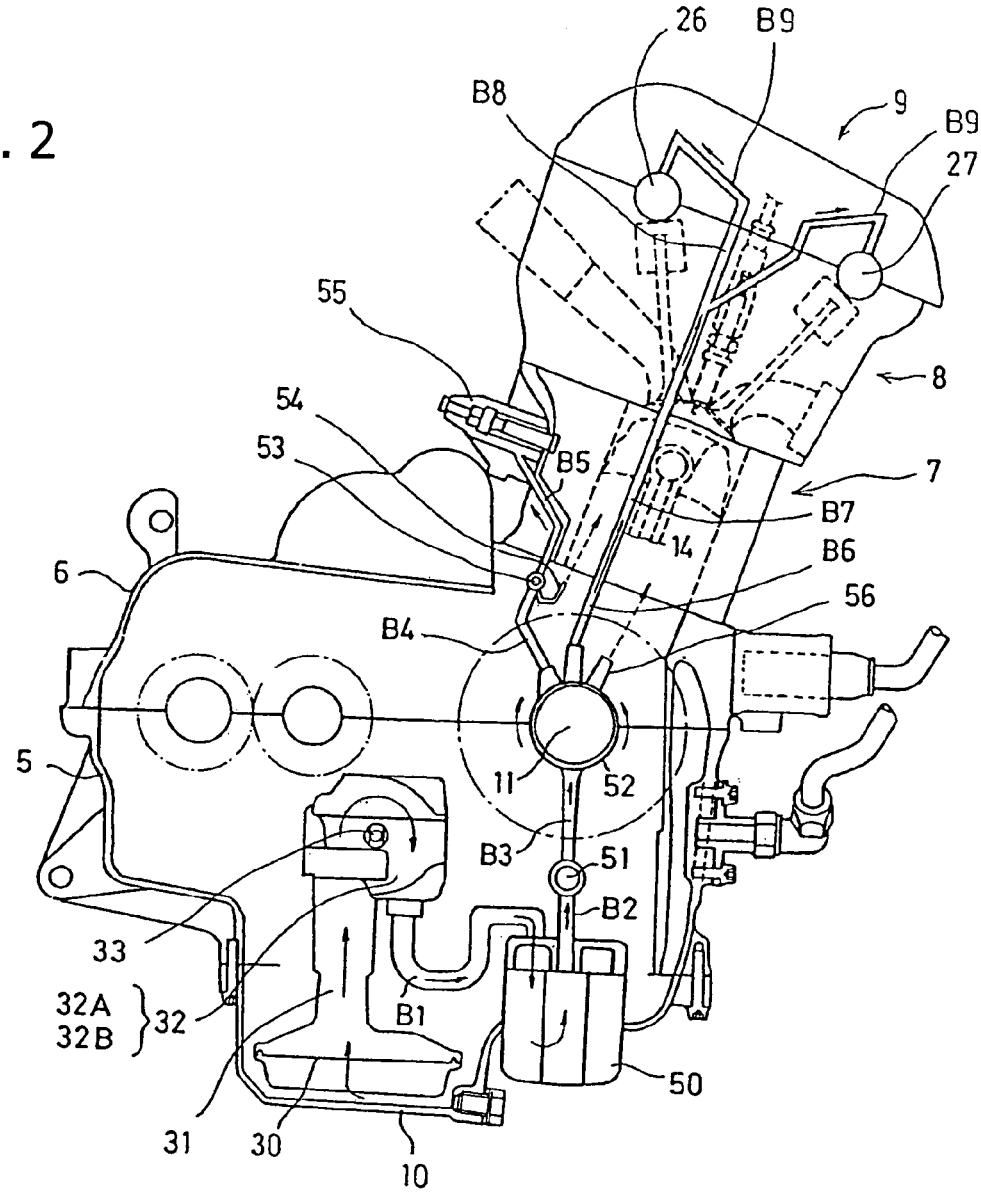
FIG. 2 is a side sectional view of the internal combustion engine of FIG. 1 showing a lubricating system oil circuit.

In the lubricating system oil circuit of FIG. 2, a lubricating system discharge pipe B1 is connected at one end to the lubricating system oil pump 32B, extends forwardly while it is curved in the oil pan 10, and is connected at a second end to an oil filter 50. A main gallery 51 is provided above the oil filter 50 and below the crankshaft 11 in the lower crankcase. An oil filter exit pipe B2 extends upward from a central portion of the oil filter 50, and is connected to the main gallery 51. In order to support the crankshaft 11, journal bearings 52 are provided between a plurality of partition walls of the lower crankcase 5 and a plurality of partition walls of the upper crankcase 6. Oil paths B3 are bored in wall members of the partition walls of the lower crankcase such that they are branched from the main gallery 51 and extend to the plurality of journal bearings 52.

An oil jet oil gallery 53 is provided at an upper portion of the upper crankcase 6. The oil jet oil gallery 53 communicates with one of the journal bearings 52 at a central location by an oil path B4 bored in one of the partition walls of the upper crankcase. A rear injection nozzle 54 is provided for each of the cylinder holes 14, and connects to the oil jet oil gallery 53 so that oil is injected to a rear portion of each cylinder hole. Oil for lubricating a chain tensioner 55 is supplied from the oil jet oil gallery 53 through an oil path B5. A front injection nozzle 56 is provided in an upper crankcase partition wall of a side portion of each of the cylinder holes 14 and communicates with the corresponding journal bearing 52 such that oil passing through the journal bearings 52 is injected toward a front portion of the cylinder hole 14.

An oil path B6 is bored in one of the upper crankcase partition walls such that it communicates with a circumferential portion of one of the journal bearings 52 different from the above-mentioned central journal bearing 52 and extends upwardly. Consequently, lubricating oil is fed to the intake camshaft 26 and the exhaust camshaft 27 through a cylinder block oil path B7, a cylinder head oil path B8, and an upper oil path B9. The oil having lubricated the camshaft and so forth returns to the oil pan 10 through the cam chain chamber at the central location. An outline of the lubricating system oil circuit is such as described above.

Figure 3:
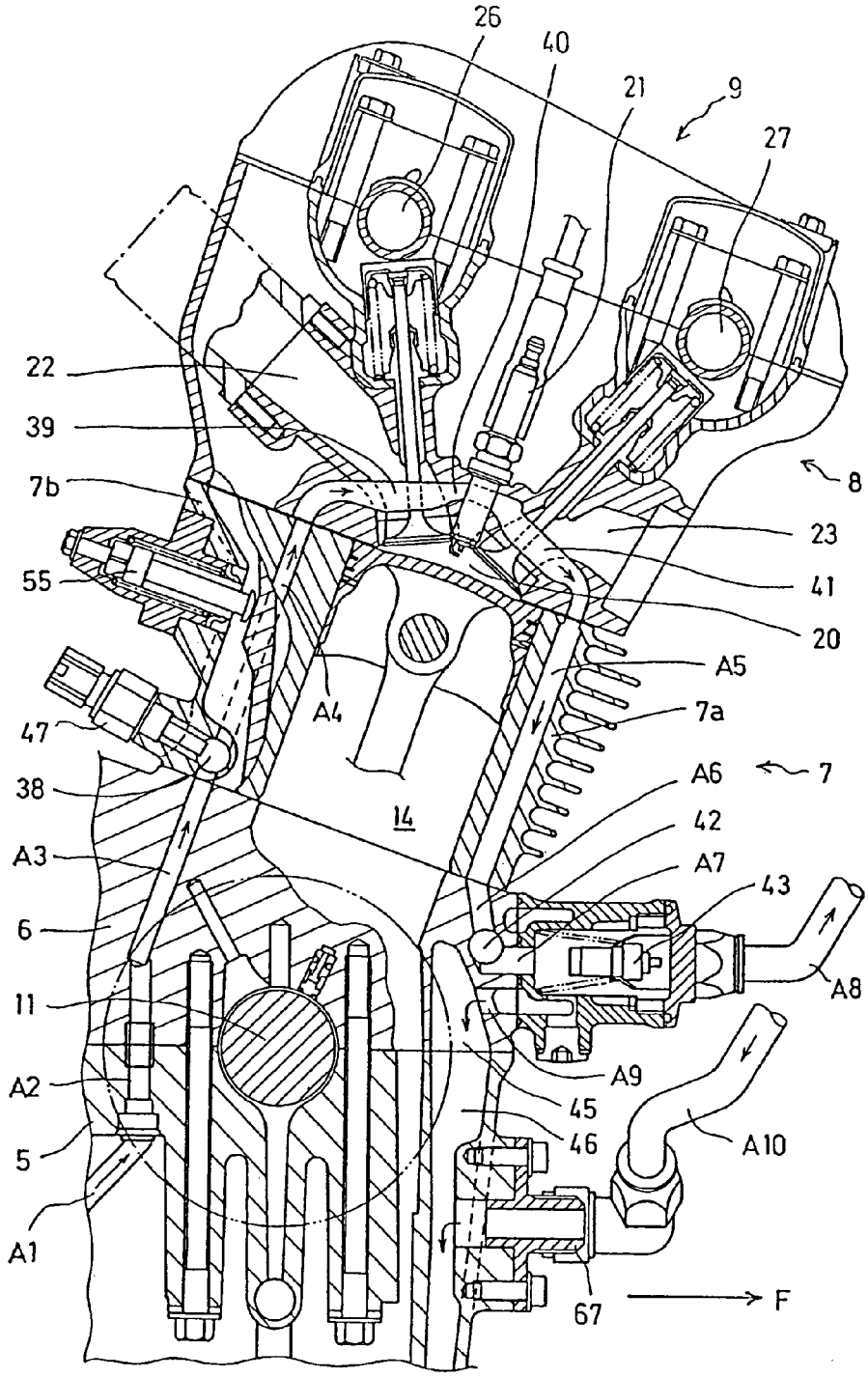
FIG. 3 is a partial side sectional view of the internal combustion engine of FIG. 1 showing detail of the cylinder block and cylinder head in which the thermostat is mounted to a front portion of the crankcase just below the cylinder block, and the oil temperature sensor is mounted to a rear portion of the cylinder block.

FIG. 3 is a vertical sectional view of a principal part of the internal combustion engine 1 described above. An arrow mark F indicates the forward direction of the engine. Referring to FIG. 3, the cooling system discharge pipe A1, connected to the cooling system oil pump 32A, extends upwardly. This pipe extends to the cooling system supply side oil gallery 38 provided in the cylinder block 7 via the lower crankcase oil path A2 and the upper crankcase oil path A3. The oil path from the oil gallery 38 is branched into the cooling system supply oil paths A4. The cooling system supply oil paths A4 supply cooling oil to each cylinder and are formed independently of each other in a rear wall 7*b* of the cylinder block 7. The cooling system supply oil paths A4 further connect to oil in-flow paths 39 of the cylinder head cooling oil jackets 40. The cooling oil jackets 40 are provided independently of each other for each of the individual cylinders. The oil in-flow paths 39, oil jackets 40 and oil out-flow paths 41 connect to each other in the forward-and-backward direction of the engine. The oil out-flow paths 41 of the oil jackets 40 connect to the cooling system returning oil paths AS. The cooling system returning oil paths A5 are provided independently of each other in a cylinder block front wall 7*a*, and extend to the cooling system returning side oil galleries 42 via the oil paths A6 provided in the upper crankcase 6.

Figure 4:
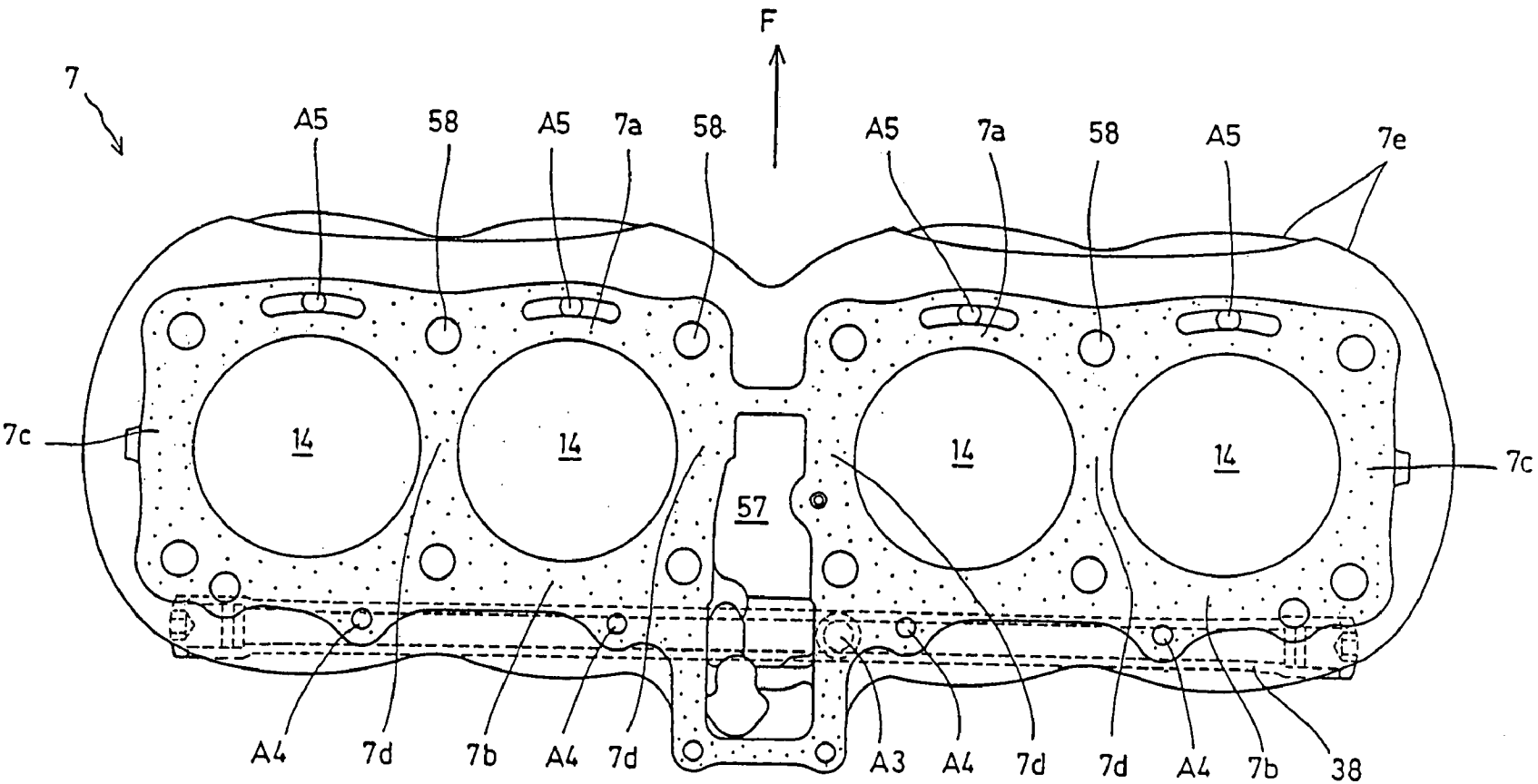
FIG. 4 is a top view of an upper face of a cylinder block of the internal combustion engine of FIG. 1, showing the cylinder arranged symmetrically about the chain chamber and showing the cooling system supply side oil gallery positioned along the rear side of the cylinder block.

FIG. 4 is a view of an upper face of the cylinder block 7 as viewed from above. An arrow mark F indicates the forward direction of the engine. A chain chamber 57 for accommodating the camshaft driving chain therein is provided at a central location of the cylinder block 7. A total of four cylinder holes 14 are disposed two by two on the opposite sides of the chain chamber 57. A cylinder block front wall 7*a*, elongated in the leftward and rightward direction of the engine, is provided at a front portion of the cylinder, and a rear wall 7*b*, elongated in the leftward and rightward direction of the engine, is provided at a rear portion of the cylinders. Further, cylinder side walls 7*c*, elongated in the forward and backward direction of the engine, are provided on the opposite side portions of the cylinders, and partition walls 7*d*, elongated in the forward and backward direction of the engine, are provided between the chain chamber 57 and the cylinder holes 14, and between cylinder adjacent cylinder holes 14. Internal spaces formed within the cylinder block 7, that is, the chain chamber 57 and the plurality of cylinder holes 14, are surrounded by the cylinder block front wall 7*a*, rear wall 7*b*, cylinder side walls 7*c* and partition walls 7*d*. Connecting bolt communicating holes 58 for coupling the cylinder block 7, cylinder head 8 and cylinder head cover 9 to the upper crankcase 6 are provided at portions at which the wall members intersect with each other. Air-cooling fins 7*e* project around the cylinder.

The cooling system supply side oil gallery 38 is provided along a lower portion of the cylinder block rear wall 7*b*, and an upper end of the oil path A3 for supplying oil from the oil pump 32A is connected to the oil gallery 38 in the proximity of the chain chamber 57. The cooling system supply oil paths A4, branching from the oil gallery 38 and extending toward the oil jackets 40 of the cylinder head, are provided individually in the cylinder rear walls 7*b*. The oil in-flow paths 39 of the oil jackets 40 provided in the cylinder head 8, hereinafter described, communicate with the upper ends of the oil paths A4. The cooling system returning oil paths A5, connected with the oil out-flow paths 41 of the oil jackets 40, are individually provided on the front side of the cylinder holes 14 of the cylinder block front wall 7*a*.

Figure 5:
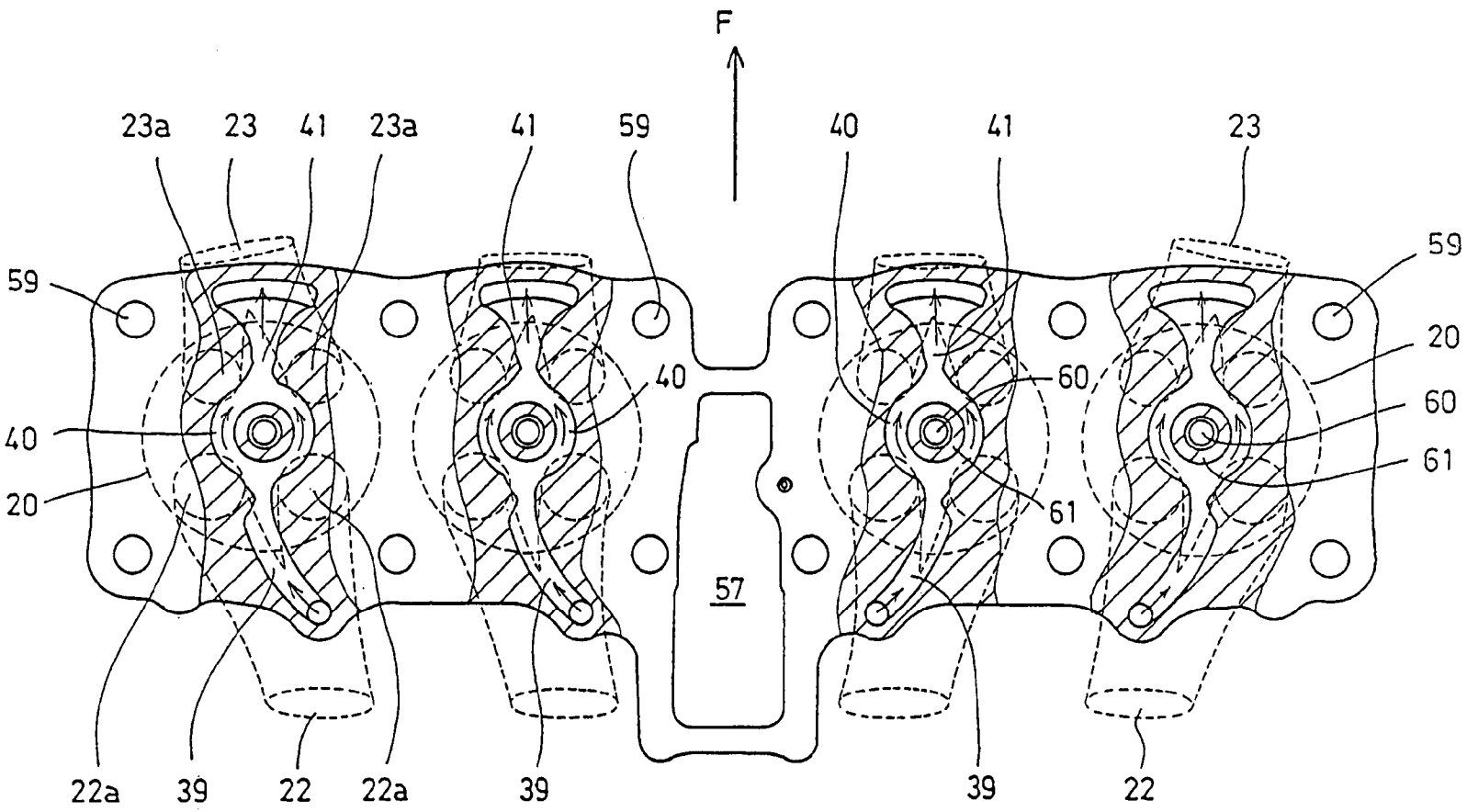
FIG. 5 is a top perspective view of a lower portion of a cylinder head of the internal combustion engine of FIG. 1, showing the respective oil inflow and outflow paths of the oil jacket positioned between the bifurcated portions of the intake port and exhaust port of the cylinder.

FIG. 5 is a view of a lower portion of the cylinder head 8 as viewed in perspective from above, and partly shows a transverse section of the oil jackets 40 as viewed from above. An arrow mark F indicates the forward direction of the engine. An opening corresponding to the camshaft driving chain chamber 57 is provided at a central portion of the lower portion of the cylinder head 8. Four combustion chambers 20 (one combustion chamber associated with each of the four cylinders 14) are arranged two by two on the opposite sides of the opening in an opposing relationship to the cylinder holes 14. Connecting bolt fitting holes 59, which connect to the connecting bolt communicating holes 58 of the cylinder block, are provided around circumferential portions of the combustion chambers 20. An intake port 22 is provided rearward of each of the combustion chambers 20, and an exhaust port 23 is provided forward of each of the combustion chambers 20. Each of the intake ports 22 and the exhaust ports 23 is bifurcated in the proximity of the combustion chamber such that the intake port 22 has two openings 22*a* on the combustion chamber side and the exhaust port 23 has two openings 23*a* on the combustion chamber side.

A spark plug mounting portion 61 is provided at the center of each of the combustion chamber 20, and has a spark plug mounting hole 60 provided at the center thereof. An oil jacket 40 is provided around each of the spark plug mounting portions 61. Each oil jacket 40 extends at front and rear portions of the spark plug mounting portions 61 in the forward and backward directions, so as to form an oil in-flow path 39 and an oil out-flow path 41. The oil in-flow path 39 communicates with a cooling system supply oil path A4 of the cylinder block 7, while the oil out-flow path 41 communicates with a cooling system returning oil path A5 of the cylinder block 7.

Oil flowing in from the oil in-flow path 39 of each of the oil jackets 40 is branched into two flows at the spark plug mounting portion 61. Oil flowing in from the oil in-flow path 39 of each of the oil jackets 40 cools peripheral portions of the spark plug mounting portion 61, and then joins together and flows out into the oil out-flow path 41. The oil in-flow path 39 of the oil jacket 40 is formed between the bifurcated portions of the intake port 22, and the oil out-flow path 41 is formed between the bifurcated portions of the exhaust port 23. Consequently, not only the peripheral portions of the spark plugs 21, but also the peripheral portions of the intake ports 22 and the exhaust ports 23, is cooled.

In the oil paths in the oil jackets 40 described above, the surface area of the oil out-flow path 41, provided between the bifurcated portions of the exhaust port 23, is set greater than that of the oil in-flow path 39, provided between the bifurcated portions of the intake port 22. Since the heat receiving area of the exhaust side on which the thermal load is higher is larger, cooling superior in thermal balance is anticipated.

In the oil paths in the oil jackets 40 described above, the path width of the oil in-flow path 39, which passes between the bifurcated portions of the intake port 22 as viewed from above the cylinder, is substantially fixed. However, the oil out-flow path 41, which passes through the bifurcated portions of the exhaust port 23, is formed such that the path width thereof, as viewed from above the cylinder, gradually increases from the spark plug mounting hole 60 toward the exhaust side as the heat receiving area of the exhaust side increases as described above. Consequently, upon casting of the cylinder head, the core for formation of the oil jacket is formed as a self-supporting type, which facilitates the casting thereof.

Figure 6:
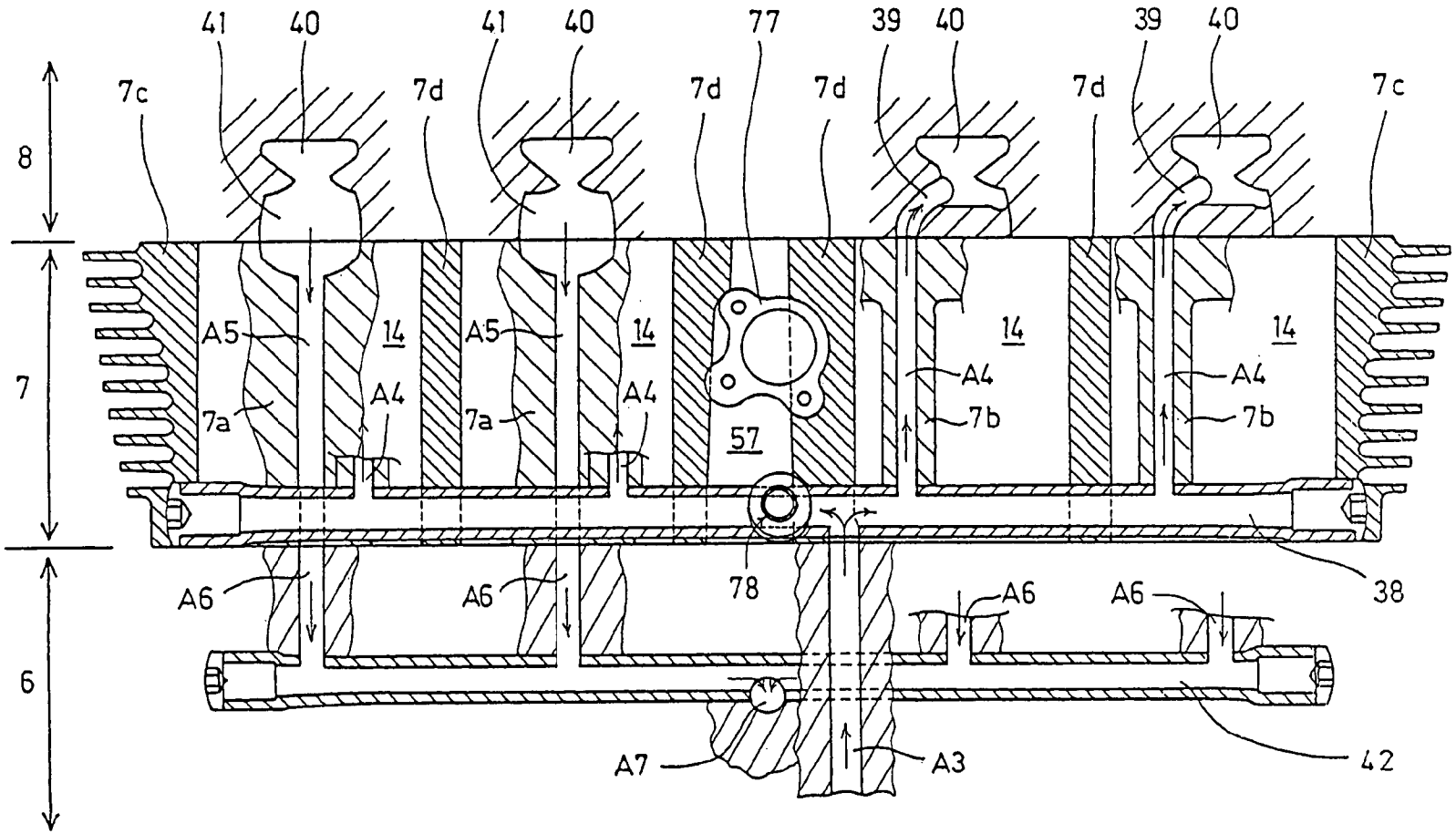
FIG. 6 is a cross sectional view of part of an upper crankcase, the cylinder block and the cylinder head of the internal combustion engine of FIG. 1 as viewed from the rear, showing, in an overlapping relationship, cooling oil supplied to the oil jackets on the right side of the figure and cooling oil returned from the oil jackets on the left side of the figure.

FIG. 6 is a cross sectional view of part of an upper crankcase 6, the cylinder block 7 and the cylinder head 8 of the internal combustion engine 1 as viewed from the rear, showing, in an overlapping relationship, cooling oil supplied to the oil jackets 40 on the right side of the figure and cooling oil returned from the oil jackets 40 on the left side of the figure. The cylinder block 7 includes the chain chamber 57 formed at a central portion thereof, and the cylinder holes 14 formed two by two on the left and right thereof. The cylinder holes 14 are partitioned by the left and right cylinder side walls 7*c* and the partition walls 7*d*. The transversely elongated cooling system supply side oil gallery 38 is provided at a rear portion of the cylinder block 7 (on near side in the figure). The upper crankcase oil path A3 is provided in the upper crankcase 6, which is connected to the lower side of the cylinder block 7. The upper crankcase oil path A3 is connected to the approximate center of the oil gallery 38 so that oil is supplied thereto. The transversely elongated cooling system returning side oil gallery 42 is provided at a front portion of the upper crankcase 6 (on far side in the figure). The oil jackets 40 are provided in the cylinder head 8.

In relation to a rear portion of the cylinder, on the right half of the figure, the cooling system supply oil path A4 branching from the cooling system supply side oil gallery 38, and oil in-flow paths 39 of the oil jackets and the oil jackets 40 are shown. On the left half of the figure, the oil paths are omitted leaving part of the supply oil paths A4. A chain tensioner attaching seat 77 is provided at a rear portion of the chain chamber. Further, an oil temperature sensor attaching seat 78 is provided so as to intersect a portion of the oil gallery 38. The oil temperature sensor attaching seat 78 is located in the proximity of the connection of the oil gallery 38 to the oil path A3, below the chain tensioner attaching seat 77.

In relation to a front portion of the cylinder, on the left half of the figure, the oil jackets 40, oil out-flow paths 41 of the oil jackets, cooling system returning oil paths A5 and upper crankcase returning oil paths A6 are shown. The returning oil paths A6 are shown connected to the cooling system returning side oil gallery 42. On the right half of the figure, the oil paths mentioned are omitted, leaving part of the returning oil paths A6. A single communicating oil path A7, which connects to the thermostat 43, is connected to a central portion of the cooling system returning side oil gallery 42.

Figure 7:
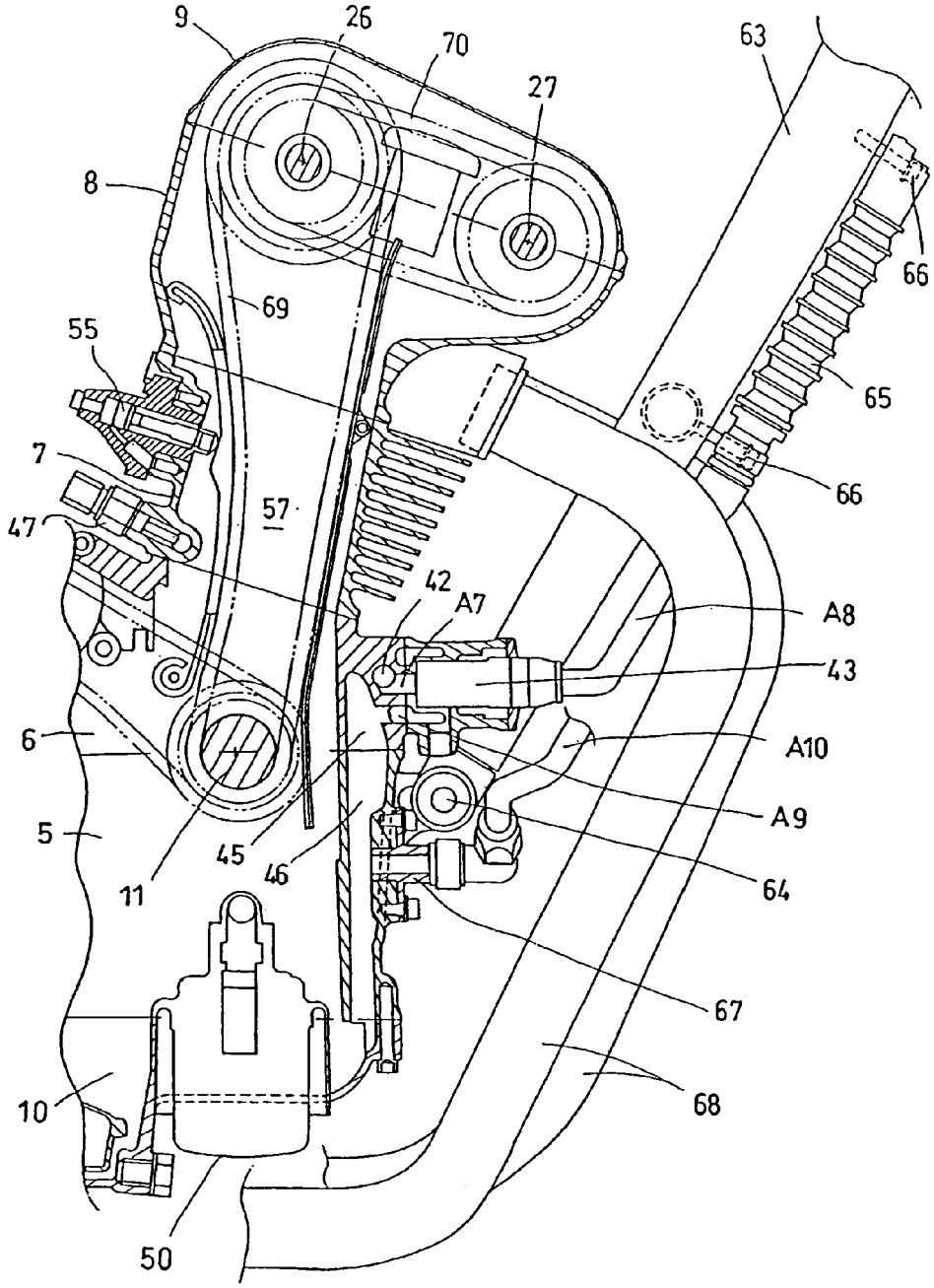
FIG. 7 is a side sectional view of a front portion of the internal combustion engine, showing the thermostat arranged between the crankcase and the exhaust pipes in the fore-and-aft direction of the engine.

FIG. 7 is a side sectional view of a front portion of the internal combustion engine 1 described hereinabove, and shows a cross section of the chain chamber 57. Within the chain chamber 57, a chain 69 extends between a sprocket wheel provided on the crankshaft 11 and another sprocket wheel provided on the intake camshaft 26, and another chain 70 extends between a further sprocket wheel provided on the intake camshaft 26 and a still further sprocket wheel provided on the exhaust camshaft 27. The internal combustion engine 1 is supported at a front portion thereof on a frame 63 by means of an internal combustion engine supporting portion 64. Also, an oil cooler 65 is supported on the frame 63 by means of supporting bolts 66.

Figure 8:
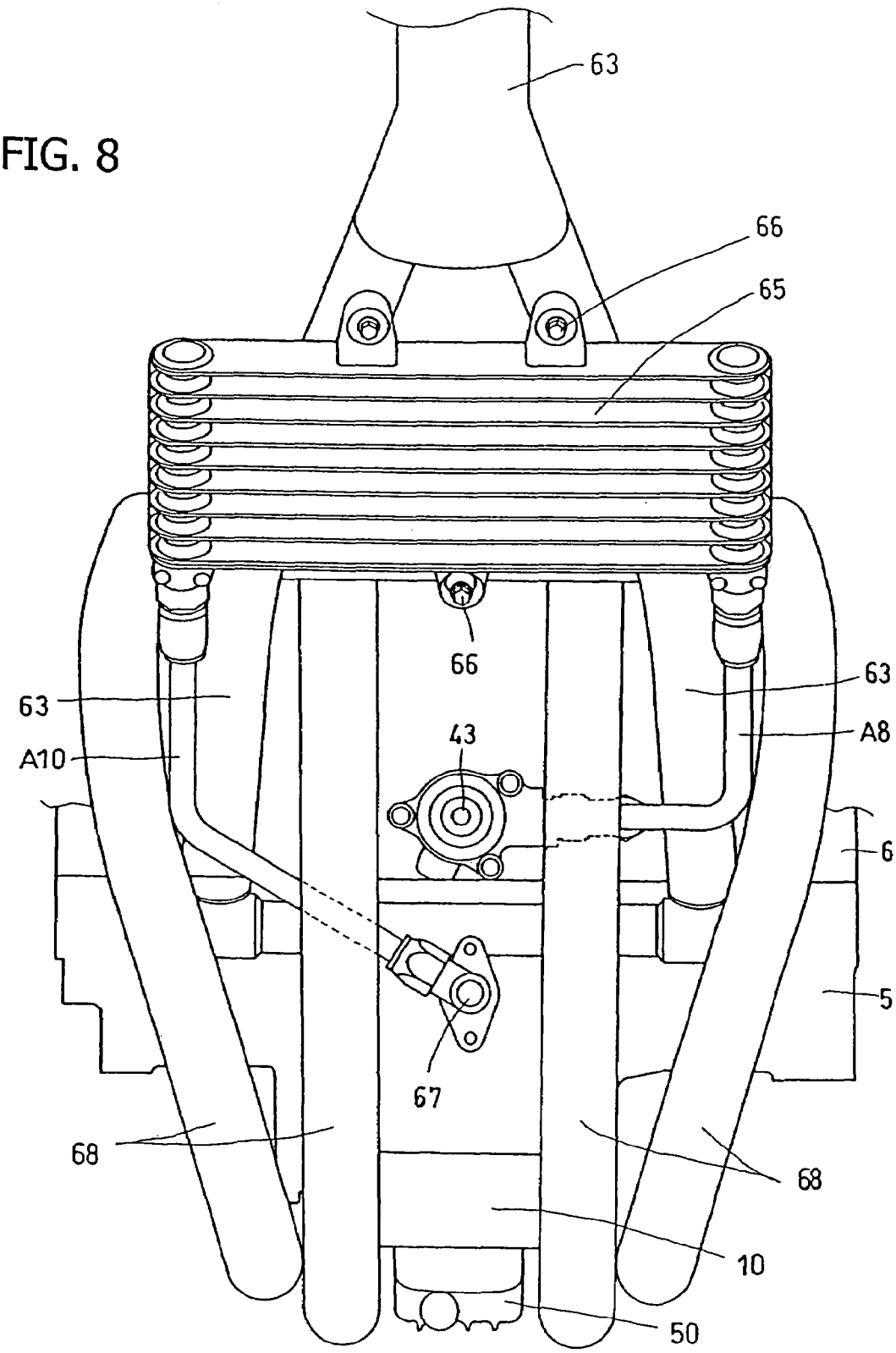
FIG. 8 is a front view of the internal combustion engine showing the thermostat arranged centrally in the width-wise direction of the engine so as to be arranged between the respective forked members of the vehicle body frame.

FIG. 8 is a view of the internal combustion engine 1 as viewed from the front of the engine. The thermostat 43 is attached to a central portion of the front face of the upper crankcase 6 in the widthwise direction of the internal combustion engine 1. The thermostat 43 is provided in a space defined on a forward side by an exhaust pipe 68, and on a rearward side by the crankcases 5 and 6 of the internal combustion engine, as viewed from the side of the vehicle. The thermostat 43 is further provided in the space so as to be surrounded on the left and right thereof by the vehicle frame 63, as viewed from the front of the vehicle.

The thermostat 43 is a temperature-sensitive valve assembly having an oil port opening toward the oil cooler 65 and another oil port opening toward the bypass path A9. The thermostat 43 opens or closes the oil ports in response to the temperature of oil flowing into the same. The attachment portion 67 of the oil cooler returning pipe A10 on the lower crankcase 5 side is attached to the front face of the lower crankcase 5 at a portion immediately below the thermostat 43.

Referring to FIGS. 7 and 8, the cooling system returning side oil gallery 42 and the thermostat 43 communicate with each other by means of the communicating oil path A7. The thermostat 43 and the entrance of the oil cooler 65 are connected to each other by the oil cooler communicating pipe A8. The bypass path A9 is provided in the proximity of the entrance of the thermostat 43, and establishes communication between the bypass side oil port of the thermostat 43 and the upper crankcase oil returning path 45. The exit of the oil cooler 65 is connected to the lower crankcase oil returning path 46 by the returning connecting pipe A10.

The upper crankcase oil returning path 45 and the lower crankcase oil returning path 46 form a single path extending in the vertical direction. An oil temperature control apparatus is constituted of the thermostat 43, bypass path A9, oil cooler communicating pipe A8, oil cooler 65, returning connecting pipe A10, oil cooler returning pipe attachment portion 67 and so forth.

When the oil temperature of cooling system returning oil flowing into the thermostat 43 through the communicating oil path A7 is high, the oil port connecting to the bypass path A9 of the thermostat 43 is closed while the oil port connecting to the oil cooler 65 is opened, and the oil flows to the oil cooler communicating pipe A8. When the oil temperature is low, the oil port connecting to the oil cooler 65 is closed while the oil port connecting to the bypass path A9 is opened, and the oil flows into the upper crankcase oil returning path 45 through the bypass path A9. In response to the oil temperature, the oil ports may assume intermediate openings. In this instance, the flow of the oil is distributed to the oil cooler direction and the bypass direction in response to the openings of the oil ports. The oil returning through the returning connecting pipe A10 after being cooled by the oil cooler 65 flows into the lower crankcase oil returning path 46, which is connected to the upper crankcase oil returning path 45. The oil flowing into the crankcase oil returning paths 45 and 46 flows downwardly and returns into the oil pan 10.

Figure 10:
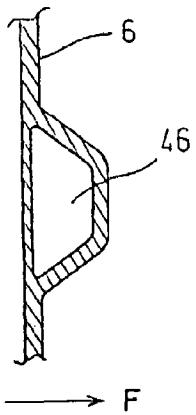
FIG. 10 is a horizontal sectional view of the lower crankcase oil returning path taken along line X-X of FIG. 9, showing the path cross sectional shape as protruding in the forward direction.
Figure 9:
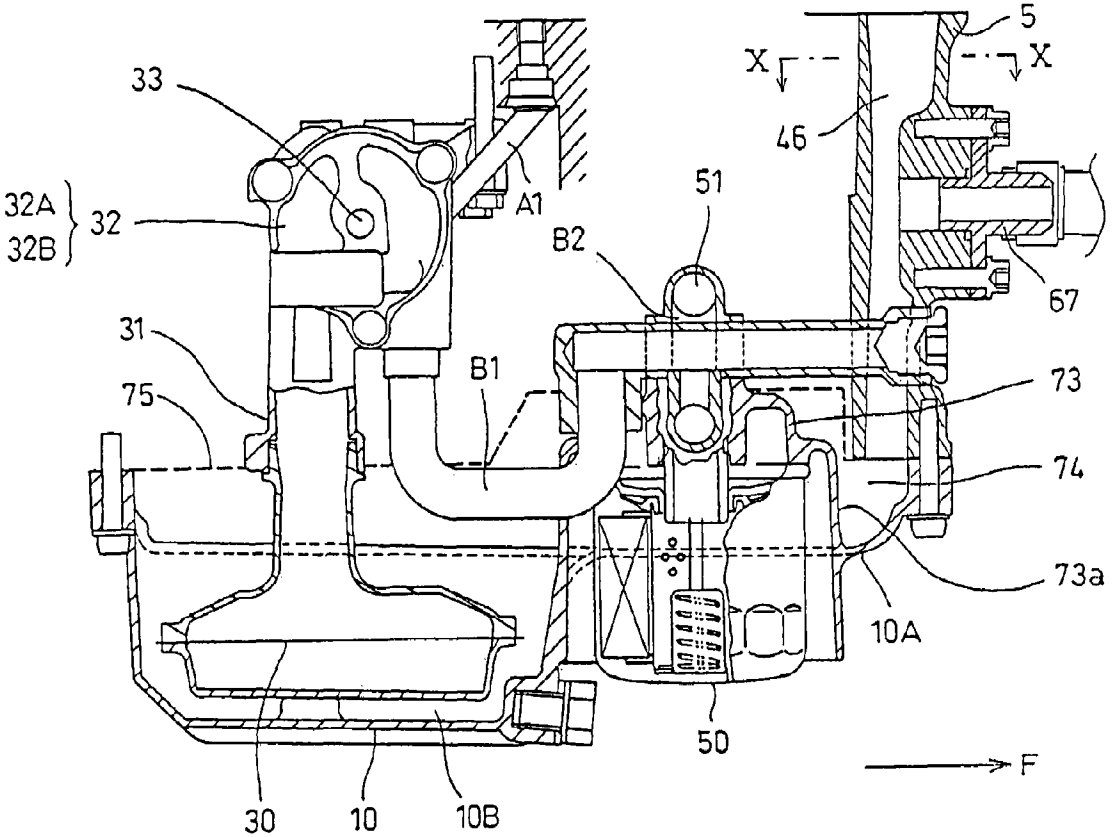
FIG. 9 is partial side sectional view of the internal combustion engine of FIG. 1, showing and enlarged view of the peripheral portions of an oil pan.

FIG. 9 is a side sectional view of peripheral portions of the oil pan 10. As shown in FIGS. 3 and 7, the oil returning path 46 is connected, at an upper portion thereof, to the oil returning path 45 provided in the upper crankcase 6. FIG. 10 is a sectional view taken along line X-X of FIG. 9 and shows a horizontal cross section of the lower crankcase oil returning path 46. An arrow mark F indicates the forward direction of the engine. Also, the oil returning path 45, provided in the upper crankcase 6, has a cross sectional shape similar to that of the oil returning path 46. The crankcase oil returning paths 45 and 46 are provided substantially at central portions of the front faces of the crankcases 5 and 6 in the widthwise direction of the internal combustion engine, respectively, and are formed in such a manner as to protrude forward. The lower crankcase oil returning path 46 is formed such that the horizontal sectional area thereof decreases toward the downstream. The oil returning paths 45 and 46 are formed integrally upon casting of the crankcase.

The oil intake pipe 31, including the strainer 30, is provided at the deep bottom portion 10B of the oil pan 10 and connects to the oil pump 32. The oil filter 50 is attached to the shallow bottom portion 10A of the oil pan 10. An oil filter attaching portion 73 protrudes into the oil pan, and the protrusion thereof is positioned between an oil pan entrance 74 at the exit of the oil returning path 46 and the strainer 30, as viewed in plan. The height of the oil filter attaching portion 73 protruded into the oil pan 10 is greater than the height of the opening of the oil pan entrance 74. The outer circumferential portion of the oil filter attaching portion 73 extends downwardly and forms an oil filter protective tube 73*a*. The lower end of the oil filter protective tube 73*a* is exposed downwardly from the lower face of the oil pan shallow bottom portion 10A.

The oil filter 50 connects to the lubricating system discharge pipe B1 connecting to the lubricating system oil pump 32B. Oil to be fed to lubrication places passes through and is purified by the oil filter 50, and the purified oil is fed to the main gallery 51 through the oil filter exit pipe B2. The cooling system oil does not pass through the oil filter 50.

A baffle plate 75 has a face above an upper face of an attaching portion of the oil filter 50 and the strainer 30 and covers an upper portion of the oil pan. The baffle plate 75 is formed from a metal plate having plural punched holes extending therethrough. Oil flowing down from the oil returning path 46 flows into the oil pan 10 from below the baffle plate 75 and passes through the shallow bottom portion 10A on the opposite sides of the oil filter 50 until it enters the deep bottom portion 10B. The baffle plate 75 is provided to suppress waving or dispersion of oil in the oil pan 10, and prevents foaming when the vehicle operates.

Referring to FIG. 6, the chain tensioner attaching seat 77 is provided at a position of a rear wall of the cylinder block corresponding to a rear portion of the chain chamber 57, and the oil temperature sensor attaching seat 78 is provided below the chain tensioner attaching seat 77. As seen in FIG. 7, the chain tensioner 55, attached to the chain tensioner attaching seat 77, is an apparatus for pushing the chain in order to maintain the appropriate tension of the chain 69 for driving the intake camshaft 26 from the crankshaft 11. The chain tensioner 55 is a mechanical tensioner which uses a spring to apply tension to the chain.

The oil temperature sensor 47, attached to the oil temperature sensor attaching seat 78 below the chain tensioner attaching seat 77, is provided at a connecting portion between the cooling system supply side oil gallery 38 and the upper crankcase oil path A3, that is, in the proximity of the entrance of the cooling system supply side oil gallery 38 as seen in FIG. 6. As seen in FIG. 3, a body portion of the oil temperature sensor 47 projects above the upper crankcase 6 and has an end facing the cooling system supply side oil gallery 38 so as to contact the oil therein. The axial line of the oil temperature sensor 47 is not at a right angle with respect to the axial line of the cylinder block 7, but instead is provided in an inclined relationship toward a location above the cylinder so that a gap remains between it and the upper crankcase 6.

Since the oil returning path structure of the present embodiment is configured and operates in such a manner as described above, the following effects are achieved.

(1) Since the oil passages conducting oil into the oil jacket have been provided between two separate parts of the fork portion of the intake port and between two separate parts of the fork portion of the exhaust port, it becomes possible to cool not only the periphery of the spark plug, but also the peripheries of the intake port and the exhaust port, and the cylinder head is effectively cooled.

(2) Since the surface area of the oil passage provided between two separate parts of the fork portion of the exhaust port has been made larger than the surface area of the oil passage provided between two separate parts of the fork portion of the intake port, by increasing a heat receiving area on the exhaust side having a high thermal load, excellent cooling in heat balance is realized.

(3) Since the width of the passage in the cylinder passing between two separate parts of the fork portion of the intake port, as viewed from above, is made substantially constant, and the width of the passage in the cylinder passing between two separate parts of the fork portion of the exhaust port, as viewed from above, has been gradually enlarged from the spark plug toward the exhaust side, excellent cooling in heat balance is realized. Furthermore, it is possible to form the oil jacket by casting, and to form the casting core for the oil jacket to be self-supporting. As a result, there is no need for machining for the formation of the oil jacket, or other members, and the cost is reduced.

(4) Since cylinder head-side oil passages, which communicate with an oil gallery and circulate the oil in the oil jacket, have been independently formed for each of the respective cylinders, it is possible to adequately control the flow rate of the oil to be supplied to each cylinder, and the heat balance between the cylinders is improved.

(5) Since the oil supply system directed to the oil jacket is a separate system from the oil supply system used for lubrication in the internal combustion engine, it is possible to precisely set the flow rate of the oil required to cool the internal combustion engine and to properly supply the amount of the oil to be required for the cooling to the cooling system, and the capacity of the oil pump is optimized. Further, since the two oil systems are separate, there is no need for causing the lubricating oil passage within the cylinder head to branch off from the cooling system oil passage, the oil passage is simplified and the working cost and the manufacturing cost are reduced. Moreover, since the engine includes the cooling system oil circuit and the lubricating system oil circuit that are independent of each other, and only the return oil of the cooling system is allowed to pass the thermostat. Therefore, proper temperature control is performed such that the cooling performance the cooling system requires is secured without being affected by the temperature of the lubricating system oil.

(6) Since only the oil that has passed the cooling system of the combustion chamber is introduced to the thermostat, oil temperature control in accordance with the thermal loading conditions of the combustion chamber is accurately achieved. Since the thermostat is directly attached to the front of the crankcase, attachment rigidity of the thermostat is increased. In addition, since the surface area of the thermostat is added to the radiating surface area of the internal combustion engine itself, the cooling performance of the engine is enhanced.

(7) Since the thermostat is substantially located at the widthwise middle point of the internal combustion engine, piping layout is optimized. In addition, since the thermostat is substantially located at the widthwise middle point of the engine that is symmetrical, external appearance of the engine is improved.

(8) The oil that has passed the bypass passage A9 and the oil that has returned from the oil cooler 65 is returned to the oil passages 45, 46 that are joined to each other to form a single passage. Therefore, the configuration of the crankcase is simplified and piping length is optimized.

(9) The thermostat 43 is located in the space surrounded by the exhaust pipe 68 and the crankcases 5, 6 of the internal combustion engine as viewed from the side of the vehicle, and at a position interposed laterally between the frames 63 as viewed from the front of the vehicle. Therefore, the thermostat is protected without an additional protective member.

(10) Since the thermostat is located alone at a position far from the oil filer, maintenance work for the thermostat is prevented from giving trouble to that for the oil filter, and vice versa.

(11) Since an oil temperature sensor (oil temperature sensor 47) is provided at a location at which it is not less likely to be influenced by a disturbance such as rainwater, high-accuracy temperature detection is achieved. Further, since the oil temperature sensor is protected against a flying stone or the like by the cylinder block and the crankcase, there is no necessity to specially provide a protective member and reduction of the cost is anticipated. Furthermore, since an engine control unit is usually placed rearward of the internal combustion engine, a harness is formed shorter by installing the oil temperature sensor rearward of the cylinder block. Consequently, the harness is reduced in weight and the arrangement of the harness is concentrated and simplified.

(12) Since the oil temperature sensor is provided for the oil supply path to the oil jacket, which requires a large amount of oil, the influence of a location where the thermal load is locally high on the oil temperature is reduced, and it is possible to detect the oil temperature as a stabilized representative value of an operation state of the internal combustion engine. Generally, when compared with a case wherein the oil temperature sensor is arranged on the oil returning side, the oil temperature detected on the supply side is lower. Particularly in an internal combustion engine to which a high thermal load is applied, or an internal combustion engine wherein an oil jacket is formed such that the internal combustion engine is cooled positively from among high-output power internal combustion engines, the oil temperature on the returning side is high. The accuracy of the temperature sensor deteriorates in a state wherein the detection temperature is high. By providing the oil temperature sensor for the oil supply path in which the temperature is low in place of an expensive temperature sensor which maintains a high degree of accuracy in a high temperature state, a stabilized representative value of an operation state is detected with a high degree accuracy by a less expensive sensor.

(13) Since the oil temperature sensor is provided in the proximity of the entrance portion of the supply side oil gallery 38, the temperature is detected in a state wherein the oil flow rate is high. Accordingly, stabilized temperature detection is anticipated.

(14) Since the supply side oil gallery is provided in a dead space at a lower end portion of the rear face of the cylinder, the internal combustion engine is compactly formed.

(15) Since the oil temperature sensor is provided in an inclined relationship in a direction in which a harness side thereof is spaced away from the crankcase with respect to the cylinder axial line, the harness length is reduced and assembly of the harness is facilitated.

(16) Since the oil temperature sensor is arranged below the chain tensioner on the rear face of the cylinder, a dead space below the chain tensioner is utilized effectively. Further, since the chain tensioner is a more rigid body than the temperature sensor, and since the temperature sensor is provided below the chain tensioner, the temperature sensor is prevented from being contacted by an article by the chain tensioner.

While a working example of the present invention has been described above, the present invention is not limited to the working example described above, but various design alterations may be carried out without departing from the present invention as set forth in the claims.

What is claimed is:

1. A cylinder head cooling structure for an internal combustion engine, the engine comprising a plurality of cylinders and a cylinder head, the cylinder head comprising a spark plug mounting hole for each cylinder, a plurality of intake ports, and a plurality of exhaust ports, the cylinder head being formed such that a cooling oil jacket is provided about the periphery of each spark plug mounting hole, wherein each of the intake ports and exhaust ports is bifurcated into a fork portion adjacent to a respective cylinder thereby creating first and second intake port branches and first and a second exhaust port branches, respectively, and wherein a respective oil entry passage is provided in said cylinder head extending between said first and second intake port branches of each intake port for conducting oil into said cooling oil jacket, and a respective oil exit passage is provided in said cylinder head extending between said first and second exhaust port branches of each exhaust port for receiving oil discharged from said cooling oil jacket.

2. The cylinder head cooling structure for an internal combustion engine according to claim 1, wherein a surface area of the oil exit passage is larger than a surface area of the oil entry passage.

3. The cylinder head cooling structure for an internal combustion engine according to claim 2, wherein a width of the oil entry passage, as viewed from above the engine, is substantially constant, and that the width of the oil exit passage gradually enlarges as it moves from the spark plug mounting hole toward an exhaust side of the engine.

4. The cylinder head cooling structure for an internal combustion engine according to claim 1, wherein cooling oil passages are formed within the cylinder head which communicate to an oil gallery and which are provided to circulate oil through said cooling oil jacket, with an independent cooling oil passage provided for each of the respective cylinders.

5. The cylinder head cooling structure for an internal combustion engine according to claim 1, wherein a cooling oil supply system for providing oil to said cooling oil jacket is separate from a lubricating oil supply system for supplying lubricating oil to the internal combustion engine.

6. A vehicle comprising an engine incorporating the cylinder head cooling structure according to claim 1, the engine being mounted on the vehicle and further comprising:

a crankcase;

a cylinder block joined to an upper side of the crankcase for housing the plurality of cylinders, the cylinders inclining slightly in a forward direction of the vehicle;

the cylinder head being joined to an upper side of the cylinder block;

an oil cooler located on the vehicle forward of the cylinder block;

a bypass oil passage that detours around the oil cooler; and a thermostat used for controlling introduction of oil into to one of the oil cooler and the bypass oil passage;

wherein the oil discharged from the cooling oil jackets is directed toward the front side of the cylinder head;

the thermostat is attached to the front of the crankcase; and wherein during engine operation, oil that has been discharged to the front side of the engine passes the thermostat, and the oil is subsequently delivered to the oil cooler or to the bypass oil passage.

7. The cylinder head cooling structure for an internal combustion engine according to claim 1, wherein the cylinder head cooling structure further comprises an oil temperature sensor, and wherein the engine further includes a crankcase;

a cylinder block joined to an upper side of the crankcase for housing the plurality of cylinders;

the cylinder head joined to the upper side of the cylinder block, wherein the engine is arranged on said vehicle such that a cylinder axial line extends vertically or is inclined substantially forwardly, and wherein said oil temperature sensor is provided on a rear face of said cylinder block above said crankcase.

8. A vehicle comprising a frame, and an internal combustion engine mounted on the frame, the engine comprising:

a crankcase;

a cylinder block joined to an upper side of the crankcase for housing the plurality of cylinders, the cylinders oriented so that a longitudinal axis of a cylinder extends vertically or is inclined substantially forwardly;

a cylinder head joined to an upper side of the cylinder block;

an oil cooler located on the vehicle forward of the cylinder block;

a bypass oil passage that detours around the oil cooler;

an oil temperature sensor provided on a rear face of said cylinder block above said crankcase, and a thermostat used for controlling introduction of oil into the oil cooler or into the bypass oil passage;

wherein the cylinder head has a spark plug mounting hole formed therein for each cylinder, a plurality of intake ports, and a plurality of exhaust ports, the cylinder head further having a cooling oil jacket formed therein and provided about the periphery of each spark plug mounting hole, wherein each of the intake ports and exhaust ports is bifurcated into a fork portion adjacent to a respective cylinder, and wherein an oil entry passage is provided adjacent the fork portion of each intake port for conducting oil into said cooling oil jacket, and an oil exit passage is provided adjacent the fork portion of each exhaust port for receiving oil discharged from said cooling oil jacket;

wherein oil discharged from the cooling oil jackets is directed toward the front side of the cylinder head;

wherein the thermostat is attached to a front portion of the crankcase; and wherein during engine operation, after oil that has been discharged to the front side of the engine passes the thermostat, the oil is subsequently delivered to the oil cooler or to the bypass oil passage.

9. The vehicle of claim 8, wherein the engine includes a cooling oil circuit for supplying oil to the cooling oil jackets and a lubricating oil circuit for lubricating selected movable portions of the engine, and wherein the cooling oil circuit and the lubricating oil circuit are substantially independent of each other.

10. The vehicle of claim 8, wherein the thermostat is located proximate a midpoint of the engine in a width direction thereof.

11. The vehicle of claim 8, wherein the vehicle comprises engine frames which support the engine, and the engine further comprises an exhaust pipe extending from a front face of the cylinder head, and wherein the thermostat is located in a space surrounded by the exhaust pipe and the engine as viewed from a side of the vehicle, and at a position interposed laterally between the frames as viewed from the front of the vehicle.

12. The vehicle of claim 8, wherein said engine further comprises an oil supply path formed on a rear face of the cylinder block for supplying oil to said oil jacket, and said oil temperature sensor communicates with said oil supply path.

13. The vehicle of claim 8, wherein said internal combustion engine is an overhead cam engine comprising:

a crankshaft;

a camshaft on said cylinder head;

a timing chain which transmits a driving force of said crankshaft to said camshaft; and a chain tensioner for providing a fixed tension on said timing chain, the chain tensioner provided on the rear face of said cylinder block, wherein said oil temperature sensor is arranged below said chain tensioner.

14. An oil temperature control system for an internal combustion engine on a vehicle, the engine comprising:

a crankcase;

a cylinder block joined to an upper side of the crankcase, the cylinder block comprising a cylinder and inclining slightly in the forward direction of the vehicle;

a cylinder head joined to the cylinder;

an oil jacket formed in the cylinder head used to cool the cylinder head;

an oil cooler located on the vehicle forward of the cylinder block;

a bypass oil passage that detours around the oil cooler; and a thermostat used for controlling introduction of oil into to one of the oil cooler and the bypass oil passage;

wherein oil discharged from the oil jacket is directed toward the front side of the cylinder head of the engine;

the thermostat is attached to the front of the crankcase; and wherein during engine operation, after oil that has been discharged to the front side of the engine passes the thermostat, the oil is subsequently delivered to the oil cooler or to the bypass oil passage.

15. An oil temperature control system for an internal combustion engine according to claim 14, wherein the engine includes a cooling oil circuit for supplying oil to the oil jacket and a lubricating oil circuit for lubricating selected portions of the engine, and wherein the cooling system oil circuit and the lubricating system oil circuit are substantially independent of each other.

16. An oil temperature control system for an internal combustion engine according to claim 14, wherein the thermostat is located proximate a midpoint of the engine in a width direction thereof.

17. An oil temperature control system for an internal combustion engine according to claim 16, wherein a return pipe extending from the oil cooler is connected to a portion of the engine directly below the thermostat.

18. An oil temperature control system for an internal combustion engine according to claim 14, wherein the engine is mounted in a vehicle, and the vehicle comprises frames which support the engine, and wherein the engine further comprises an exhaust pipe extending from a front face of the cylinder head, and the thermostat is located in a space surrounded by the exhaust pipe and the engine as viewed from a side of the vehicle, and at a position interposed laterally between the frames as viewed from the front of the vehicle.

19. An oil temperature sensor arrangement structure for an internal combustion engine of a vehicle, wherein the oil temperature sensor arrangement structure comprises an oil temperature sensor, wherein said internal combustion engine includes a plurality of cylinders, a crankcase, a cylinder block and a cylinder head, and is arranged on said vehicle such that a cylinder axial line extends vertically or is inclined substantially forwardly, wherein an independent oil cooling jacket is provided for each of said cylinders, wherein said temperature sensor is provided on a rear face of said cylinder block above said crankcase, and wherein said oil temperature sensor arrangement structure comprises an oil cooling jacket formed in said cylinder head of the internal combustion engine, an oil supply path formed in the engine proximate a rear face of a cylinder for supplying oil to said oil cooling jacket, and an oil return path formed in the engine for returning oil from said oil cooling jacket, a supply side oil gallery connected to said oil supply path on an upstream side of the oil jackets, and oil sub-paths connected to the individual oil jackets so as to be individually branched from said supply side oil gallery;

wherein said oil temperature sensor communicates with said oil supply path said oil temperature sensor is provided proximate an entrance portion of said supply side oil gallery from said oil supply path.

20. An oil temperature sensor arrangement structure for an internal combustion engine according to claim 19, wherein said supply side oil gallery is provided at a lower end portion of the rear face of said cylinder block.

21. An oil temperature sensor arrangement structure for an internal combustion engine according to claim 20, wherein said oil temperature sensor is provided in an inclined relationship relative to the cylinder head in a direction in which a harness side thereof is spaced away from said crankcase with respect to the cylinder axial line.

22. An oil temperature sensor arrangement structure for an internal combustion engine according to claim 19, wherein said internal combustion engine is an overhead cam engine comprising:

a crankshaft;

a camshaft on said cylinder head;

a timing chain which transmits a driving force of said crankshaft to said camshaft; and a chain tensioner for providing a fixed tension on said timing chain, the chain tensioner provided on the rear face of said cylinder block, wherein said oil temperature sensor is arranged below said chain tensioner.

* * * * *